US007076972B2

(12) United States Patent
West

(10) Patent No.: US 7,076,972 B2
(45) **Date of Patent: *Jul. 18, 2006**

(54) TUNGSTEN CARBIDE-BASED ANNULAR JEWELRY ARTICLE

(76) Inventor: Trent West, 41 Hangar Way, Watsonville, CA (US) 95076

( * ) Notice: Subject to any disclaimer, the term of this patent is extended or adjusted under 35 U.S.C. 154(b) by 0 days.

This patent is subject to a terminal disclaimer.

(21) Appl. No.: 10/633,575

(22) Filed: Aug. 5, 2003

(65) Prior Publication Data

US 2004/0020242 A1 Feb. 5, 2004

Related U.S. Application Data

(60) Continuation of application No. 10/410,656, filed on Apr. 8, 2003, now Pat. No. 6,993,842, which is a division of application No. 09/571,583, filed on May 15, 2000, now Pat. No. 6,553,667, which is a continuation-in-part of application No. 09/149,796, filed on Sep. 8, 1998, now Pat. No. 6,062,045.

(60) Provisional application No. 60/058,136, filed on Sep. 8, 1997.

(51) Int. Cl.
*A44C 9/00* (2006.01)

(52) U.S. Cl. ..... 63/15; 63/34

(58) Field of Classification Search ..... 63/15, 63/34, 26, 3, 15.1–15.9; D11/26, 37, 39; 29/896.4, 896.411, 896.412
See application file for complete search history.

(56) References Cited

U.S. PATENT DOCUMENTS

| | | | | |
|---|---|---|---|---|
| D33,674 | S | | 12/1900 | Bliss, Jr. |
| 1,192,983 | A | | 8/1916 | Bruderer |
| 1,327,606 | A | | 1/1920 | Bacharach |
| 1,431,652 | A | | 10/1922 | Grossman |
| 1,537,068 | A | | 5/1925 | Croselmire |
| 1,597,589 | A | | 8/1926 | Ferrari |
| 1,654,335 | A | | 12/1927 | Lindroth |
| 1,689,124 | A | | 10/1928 | Fitzgerald |
| 1,863,618 | A | | 6/1932 | Brogan |
| 2,016,679 | A | | 10/1935 | Mayer |
| 2,027,060 | A | | 1/1936 | Niven et al. |
| 2,050,253 | A | | 8/1936 | Bager |
| 2,062,891 | A | * | 12/1936 | Kousin ..... 368/285 |
| 2,128,644 | A | * | 8/1938 | Gittler ..... 63/15 |
| 2,161,549 | A | | 6/1939 | Most |
| 2,332,344 | A | * | 10/1943 | Roskin ..... 63/15 |
| 2,450,762 | A | | 10/1948 | Marshall |
| 3,242,664 | A | | 3/1966 | Lederrey |

(Continued)

FOREIGN PATENT DOCUMENTS

| | | |
|---|---|---|
| AU | 208883 | 8/1956 |

(Continued)

OTHER PUBLICATIONS

Sharr Choate, "Creative Gold- and Silversmithing," 1970, pp. 58-68, 139-150, 165-170, 188, 245-264.

(Continued)

*Primary Examiner*—William L. Miller
(74) *Attorney, Agent, or Firm*—Winston & Strawn LLP

(57) ABSTRACT

Wear resistant jewelry apparatus and method of making same wherein articles of jewelry are made from sinterable metal and/or ceramic powder materials compressed into a predetermined configuration and then sintered to form a blank from which a jewelry item may be made and to which softer precious metals, stones, crystals or other materials suitable for use in jewelry may be affixed. Such items of jewelry may have multiple facets and can be fabricated using various disclosed techniques and various combinations of materials.

24 Claims, 5 Drawing Sheets

U.S. PATENT DOCUMENTS

| | | | | | |
|---|---|---|---|---|---|
| 3,409,416 | A | | 11/1968 | Yates | |
| 3,413,392 | A | | 11/1968 | Meadows | 264/102 |
| 3,417,223 | A | | 12/1968 | Steigerwald | |
| 3,606,766 | A | | 9/1971 | Hill | |
| 3,669,695 | A | | 6/1972 | Iler et al. | |
| 3,712,079 | A | | 1/1973 | Eberle | |
| 3,719,479 | A | | 3/1973 | Flanagan | |
| 3,725,634 | A | | 4/1973 | Lane | |
| 3,776,706 | A | * | 12/1973 | Daniels et al. | 75/233 |
| 3,837,163 | A | | 9/1974 | Fujimori | |
| 3,841,848 | A | | 10/1974 | Kasai et al. | |
| 3,901,717 | A | | 8/1975 | Revaz | |
| 4,090,284 | A | | 5/1978 | Kraft | |
| 4,281,235 | A | | 7/1981 | Peloquin | |
| 4,387,627 | A | | 6/1983 | Avezou | |
| 4,549,058 | A | | 10/1985 | DelMastro et al. | |
| 4,574,011 | A | * | 3/1986 | Bonjour et al. | 75/241 |
| 4,706,857 | A | * | 11/1987 | Aellen et al. | 224/164 |
| 4,740,935 | A | | 4/1988 | Gogniat | |
| 4,891,276 | A | | 1/1990 | Exner | |
| 5,003,678 | A | * | 4/1991 | Oganesyan | 29/10 |
| 5,431,028 | A | | 7/1995 | Lampert et al. | 63/2 |
| 5,462,772 | A | | 10/1995 | Lemelson | |
| 5,678,428 | A | * | 10/1997 | Pasquetti | 63/15.2 |
| 5,968,428 | A | | 10/1999 | Kuwabara | 264/86 |
| 6,020,826 | A | * | 2/2000 | Rein | 340/5.65 |
| 6,062,045 | A | * | 5/2000 | West | 63/15 |
| D435,475 | S | * | 12/2000 | Canty | D11/26 |
| 6,260,383 | B1 | * | 7/2001 | Warren et al. | 63/15 |
| 6,546,749 | B1 | * | 4/2003 | Canty | 63/3 |
| 6,553,667 | B1 | * | 4/2003 | West | 29/896.412 |
| 6,641,640 | B1 | * | 11/2003 | Hesse et al. | 75/236 |

FOREIGN PATENT DOCUMENTS

| | | | |
|---|---|---|---|
| GB | 950127 | | 2/1964 |
| GB | 2 210 249 | | 6/1989 |
| JP | 56084375 | A | 7/1981 |
| JP | 59-076801 | | 5/1984 |
| JP | 61-177351 | | 8/1986 |
| JP | 64-008245 | | 1/1989 |
| JP | 9268241 | | 10/1997 |
| WO | WO 96/17319 | * | 6/1996 |
| WO | WO 99/12443 | | 3/1999 |
| WO | WO 02/21962 | | 3/2002 |

OTHER PUBLICATIONS

Boccia® Titanium, The Boccia Titanium Jewelry Collection, Universal Watch Co., Inc., Framingham, MA 01702, Aug. 6, 2002.

Titanium Era Webpage. [Available] http://www.titaniumera.com/tungsten.html; © 1994-2003.

Progressive Jewelers.com Webpage [Available] http://www.progressivejewelers.com/tungsteninlays.htm; © 2003.

The American Heritage Dictionary of the English Language, www.dictionary.com, definitions of the words "ring" and "annular".

* cited by examiner

TUNGSTEN CARBIDE-BASED ANNULAR JEWELRY ARTICLE

CROSS-REFERENCE TO RELATED APPLICATIONS

This application is a continuation of U.S. application Ser. No. 10/410,656, filed Apr. 8, 2003 now U.S. Pat. No. 6,993,842, which is a divisional of U.S. application Ser. No. 09/571,583, filed May 15, 2000, now U.S. Pat. No. 6,553,667, which is a continuation-in-part of U.S. application Ser. No. 09/149,796, filed Sep. 8, 1998, now U.S. Pat. No. 6,062,045, which claims the benefit of Provisional Application No. 60/058,136, filed Sep. 8, 1997. The contents of each of these applications is incorporated herein by reference thereto.

FIELD OF THE INVENTION

The present invention relates generally to jewelry items such as finger rings, bracelets, earrings, body jewelry and the like, and more particularly to novel jewelry apparatus and methods of making same out of "hard" metals including tungsten carbide, either alone or in combination with precious metals and jewels such that the hardened materials protect the softer precious metals and jewels from edge and detail weardown.

BACKGROUND OF THE INVENTION

Jewelry has for centuries been made of soft materials such as gold, silver, platinum and other soft materials, because such metals were malleable, castable, forgeable, moldable or otherwise formable. However, whereas such materials are relatively easy to mold, shape and polish, they are equally subject to wear, scratching and other damage detracting from their longevity appearance and value, i.e., wearing down of edges to a smooth and rounded state.

More recently, science has produced other materials including tungsten, cemented carbide and high tech ceramics that are much harder than the previously mentioned precious metals, and once formed, are virtually indestructible when used in a normal jewelry wearing environment. The problem with such materials is that because of their hardness, they are very difficult to shape, and once formed, require special machining and/or grinding tools to alter their configuration and appearance. Accordingly, with the exception of articulated watch bands or housings for timepieces of the type made by Rado Watch Co. Ltd. of Switzerland, such materials have historically not been used for articles of jewelry of the types mentioned above. However, I have recently discovered that through the use of powder metallurgy and sintering processes, such materials can be manufactured and used to provide faceted designs that were not heretofore practiced. Furthermore, such materials can be used to enhance and protect precious metals and gemstones in this jewelry setting.

In the process of fabricating parts from powdered metals, the most important step is the one involving the welding together of the metallic powder to form a solid which will yield the proper shape and the properties required of the finished part. Although a good weld cannot be made between metals at room temperature by pressure alone, when the metal particles are relatively fine and plastic, a welding may occur that is satisfactory from the viewpoint of handling, although little or no strength will be developed. Under pressure, at room temperature, metal powders that are plastic and relatively free from oxide films, may be compacted to form a solid of the desired shape having a strength (green strength) that allows the part to be handled. This result is often called cold-welding. The welding under pressure of the metal particles in order form a solid blank of the shape desired, requires the use of pressures varying from 5 to 100 tons/in$^2$. Relatively light loads are used for the molding of the softer and more plastic metals, while pressures approaching 100 tons/in$^2$ are necessary when maximum density is needed and when pressing relatively hard and fine metal powders such as those used in accordance with the present invention.

Commercial pressing is done in a variety of presses which may be of the single mechanical punch-press type or the double-action type of machine that allows pressing from two directions by moving upper and lower punches synchronized by means of cams. These machines also incorporate moveable core rods which make it possible to mold parts having long cores, assist in obtaining proper die fills and help in the ejection of the pressed parts.

The molding of small parts at great speeds and at relatively low pressures can be accomplished using the mechanical press. For example, mechanical presses can produce parts at the rate of 300 to 30,000 parts per hour. A satisfactory press should meet certain definite requirements among which are the following: (1) sufficient pressure should be available without excessive deflection of press members; (2) the press must have sufficient depth of fill to make a piece of required heights dependent upon the ratio of loose powder to the compressed volume, this being referred to as the compression ration; (3) a press should be designed with an upper or lower punch for each pressing level required in the finished part, although this may be taken care of by a die design with a shoulder or a spring mounted die which eliminates an extra punch in the press; and (4) a press should be designed to produce the number of parts required. The punches are usually made from an alloy of tungsten carbide or punched steel that can be hardened by oil quenching.

Heating of the cold-welded metal powder is called the "sintering" operation. The function of heat applied to the cold-welded powder is similar to the function of heat during a pressure-welding operation of steel in that it allows more freedom for the atoms and crystals; and it gives them an opportunity to recrystallize and remedy the cold deformation or distortion within the cold pressed part. The heating of any cold-worked or deformed metal will result in recrystallization and grain growth of the crystals or grains within the metal. This action is the same one that allows one to anneal any cold work-hardened metal and also allows one to pressure-weld metals. Therefore, a cold-welded powder will recrystallize upon heating, and upon further heating, the new crystals will grow, thus the crystal grains become larger and fewer.

The sintering temperatures employed for the welding together of cold-pressed powders vary with the compressive loads used, the type of powders, and the strength required of the finished part. Compacts of powders utilized in accordance with the present invention are typically sintered at temperatures ranging from about 1000° C. to in excess of 2000° C. for approximately 30 minutes. When a mixture of different powders is to be sintered after pressing and the individual metal powders in the compact have markedly different melting points, the sintering temperatures used can be above the melting point of one of the component powders. The metal with a low melting point will thus become liquid; however, so long as the essential part or major metal powder is not molten, this practice may be employed. When the solid phase or powder is soluble in the liquid metal, a marked dilution of the solid metal through the liquid phase may occur which will develop a good union between the particles and result in a high density.

Most cold-pressed and metal ceramic powders shrink during the sintering operation. In general factors influencing shrinkage include particle size, pressure used in cold-welding, sintering temperature and time employed during the sintering operation. Powders that are hard to compress will cold-shrink less during sintering. It is possible to control the amount of shrinkage that occurs. By careful selection of the powder and determination of the correct pressure of cold-forming, it is possible to sinter so as to get minimal volume chance. The amount of shrinkage or volume change should be determined so as to allow for this change in the design of the dies used in the process of fabricating a given shape.

The most common types of furnace employed for the sintering of pressed powders is the continuous type. This type of furnace usually contains three zones. The first zone warms the pressed parts, and the protective atmosphere used in the furnaces purges the work of any air or oxygen that may be carried into the furnace by the work or trays. This zone may be cooled by water jackets surrounding the work. The second zone heats the work to the proper sintering temperature. The third zone has a water jacket that allows for rapid cooling of the work and the same protective atmosphere surrounds the work during the cooling cycle.

Protective atmospheres are essential to the successful sintering of pressed powders. The object of such an atmosphere is to protect the pressed powders from oxidation which would prevent the successfully welding together of the particles of metal powder. Also if a reducing protective atmosphere is employed, any oxidation that may be present on the powder particles will be removed and thus aide in the process of welding. A common atmosphere used for the protection and reduction of oxides is hydrogen. Water vapor should be removed from the hydrogen gas by activated alumina dryers or refrigerators before it enters the furnace.

SUMMARY OF THE INVENTION

The invention relates to a jewelry article having an annular body formed of tungsten carbide. The annular body has at least one external face that is ground to a predetermined shape. The tungsten carbide is long wearing and virtually indestructible during normal use.

In a preferred embodiment, the article is a finger ring having at least two frusto-conically shaped facets extending around its outer circumference and a cylindrically shaped exterior portion forming a third surface. Other embodiments may include facets having surface angles of 1 to 40 degrees relative to the axis of symmetry of the body. Various surfaces of the ring may be ground to a mirror finish. Additional embodiments may include additional facets.

In general, the hard material of the invention will typically have a density of at least 13.3 g/cm$^3$. In one embodiment, the density is at most 15.1 g/cm$^3$. In one embodiment, the hard material includes predominantly sintered tungsten carbide, preferably including at least 85 weight % tungsten carbide. In one embodiment, the hard material includes sintered tungsten carbide and at least one binder. In one embodiment, the hard material includes sintered tungsten carbide and chromium carbide. In another embodiment, the hard material includes sintered tungsten carbide and nickel, while in another it includes sintered tungsten carbide and cobalt. In a preferred embodiment, the hard material includes sintered tungsten carbide, chromium carbide, nickel, and cobalt.

Various embodiments of the invention may include cavities that may be grooves, slots, notches, or holes wherein a precious metal or gemstone may be inserted. The jewelry article may also be in the form of a ring, earring, or bracelet and may include design details that are maintained in their original configuration indefinitely. The jewelry article will no require additional polishing during use.

DETAILED DESCRIPTION OF THE PREFERRED EMBODIMENTS

Figure 1:
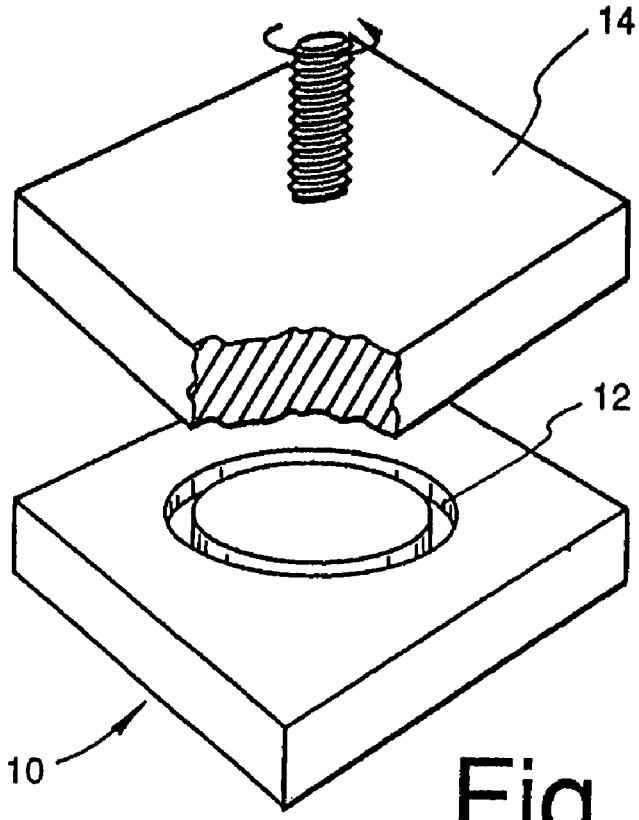
FIG. 1 is a diagram schematically illustrating a press mold of a type used to make jewelry articles in accordance with the present invention.

Referring now to FIG. 1 of the drawing, a compressive mold is depicted at 10 including an annular cavity 12 generally illustrated and configured to receive a quantity of powdered, hard metal or high tech ceramic material that can be compressed and formed into an oversized "green" ring blank by the application of compressive forces applied by a mating press member 14. The mold 10 may be made in any configuration suitable for forming a particular annular or other shape, and the illustrated cavity is sized to as to produce an annular blank that, following shrinkage during subsequent processing, will have a predetermined size and configuration. Numerous types of powdered materials can be used in accordance with the present invention. One such powder includes the following constituents:

| | |
|---|---|
| Nickel | 2% to 10% |
| Cobalt | 1% to 2% |
| Chromium or Chromium Carbide | 0.5% to 3% |
| Tungsten or Tungsten Carbide | balance |

Whereas in this example, Nickel and Cobalt are used as binder materials, other materials such as palladium, platinum, ruthenium, iridium and gold or alloys thereof, may also be used.

A ceramic composition might include:

| ZIRCONIA (wt. %) | |
|---|---|
| $ZrO_2 + HfO_2$ | 99% |
| $SiO_2$ | 0.20% |
| $TiO_2$ | 0.15% |
| $Fe_2O_3$ | 0.02% |
| $SO_3$ | 0.25% |
| LOI @ 1400° | 0.30% |

Whereas in this example, $ZrO_2$+$HfO_2$ is used as the matrix material, silicon nitrides, silicon carbides and other similar materials may be used. In addition, various castoring agents may be included in the binding materials.

Figure 2:
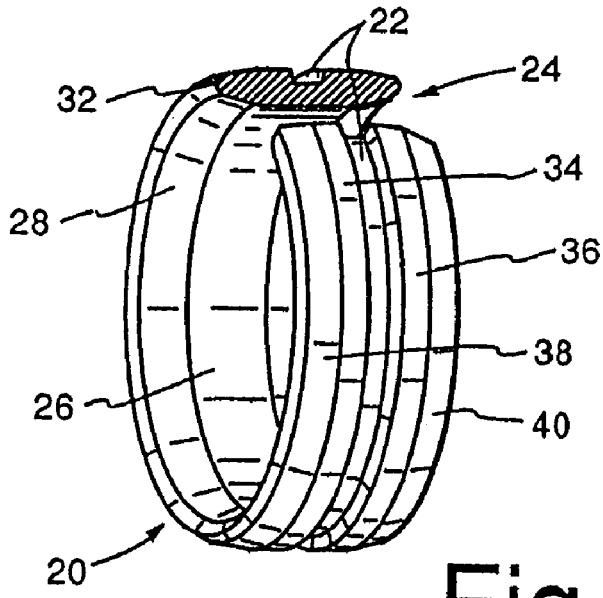
FIG. 2 is a partially broken perspective view illustrating details of one form of a molded ring component in accordance with the present invention.

In FIG. 2 of the drawing, one configuration of a ring is illustrated at 20 and includes an annular external grove 22 formed in the outer surface thereof. As illustrated in the cross-section shown in broken section at 24, the central-most portion 26 of the internal surface of the blank 20 is cylindrical with the outboard portions or facets 28 being angled relative thereto at angles typically in the range of from 1° to 30° relative to surface 26. The axial extremes of the cross-section of this embodiment are generally semicircular, as illustrated at 32, and the outer surface is configured to have cylindrical flats 34 and 36 on opposite sides of grove 22, and angled or frusto-conical shaped facets or flats 38 and 40 on the opposite sides thereof. As an alternative, the facets 38 and 40 may be configured to have multiple facet surfaces.

Figure 3:
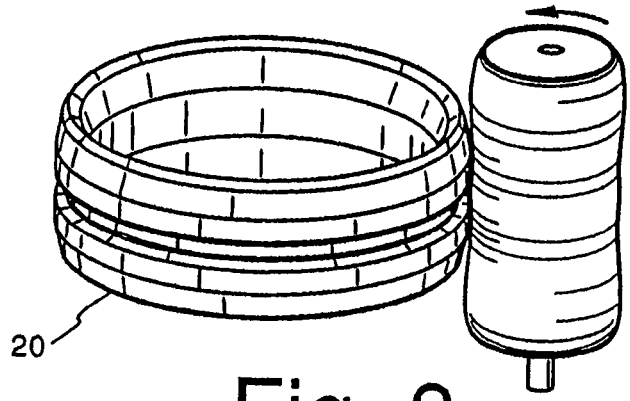
FIG. 3 is a perspective view illustrating one step in the preparation of a ring component in accordance with the present invention.
Figure 4:
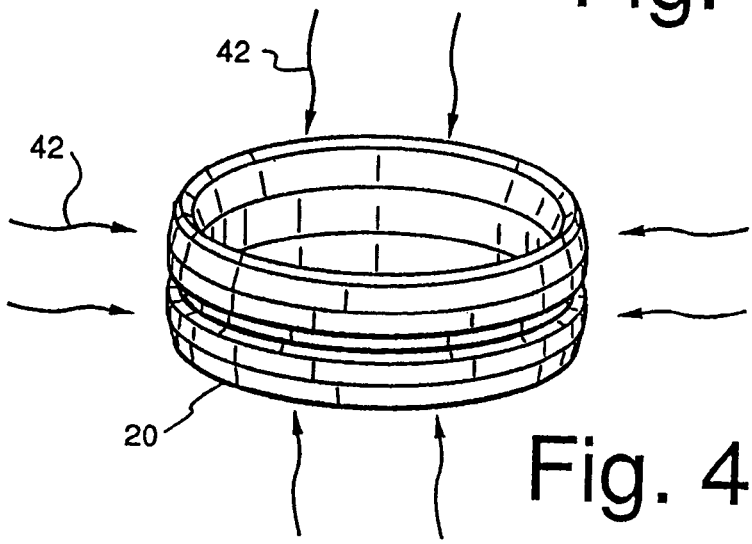
FIG. 4 is an illustration depicting a sintering step in accordance with the present invention.

Once removed from the mold, the blank 20 is shaped by machinery filing, sanding, trimming or other appropriate techniques and may he burnished as illustrated in FIG. 3 to provide a smooth or textured surface, and made ready for sintering. Once prepared, the blank 20 is inserted into a sintering oven and the temperature raised as suggested by the arrows 42, to a suitable sintering temperature for a predetermined period of time during which the blank becomes hardened and shrinks to a size appreciably smaller than the size of the original green blank. However, as indicated above, the mold was sized taking into consideration the anticipated subsequent shrinkage and as a result, the ring stock after sintering, has a predetermined size. This, of course, implies that a different mold will be required for each ring size. As an alternative, it will be understood that the blank may be pressed to have a tubular configuration from which multiple rings may be severed and machined to appropriate individual sizes.

Figure 5:
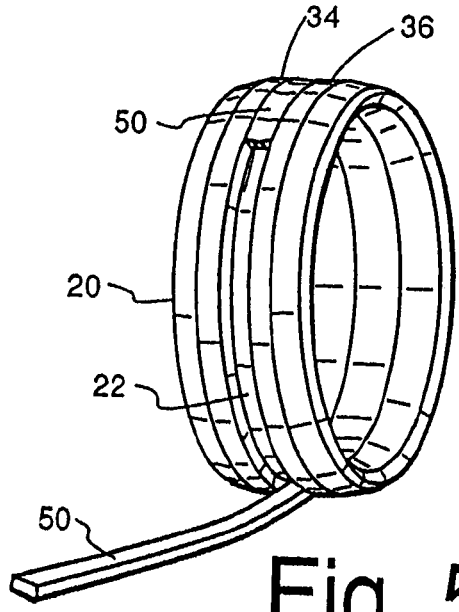
FIG. 5 is a perspective view illustrating one method of combining a precious metal component with a hard metal and/or ceramic component in accordance with the present invention.

Following the sintering operation, the ring stock can be ground and finish polished, and when appropriate, have a selected precious metal and/or other material installed in the groove 22 as suggested by the laying in of the soft metal strip 50 depicted in FIG. 5 of the drawings. Once the metal strip 50 is suitably installed using methods well known to jewelers, the assembly can be finish polished and made ready for market. It will, of course, be appreciated that other forms of materials can be inlaid into the groove 22. For example, preformed metal, stone, ceramic, shell or other segments could be glued or otherwise affixed to the ring. Preferably, such items will be slightly recessed below the surfaces of the facets 34 and 36 so as to be protected thereby.

Figure 6:
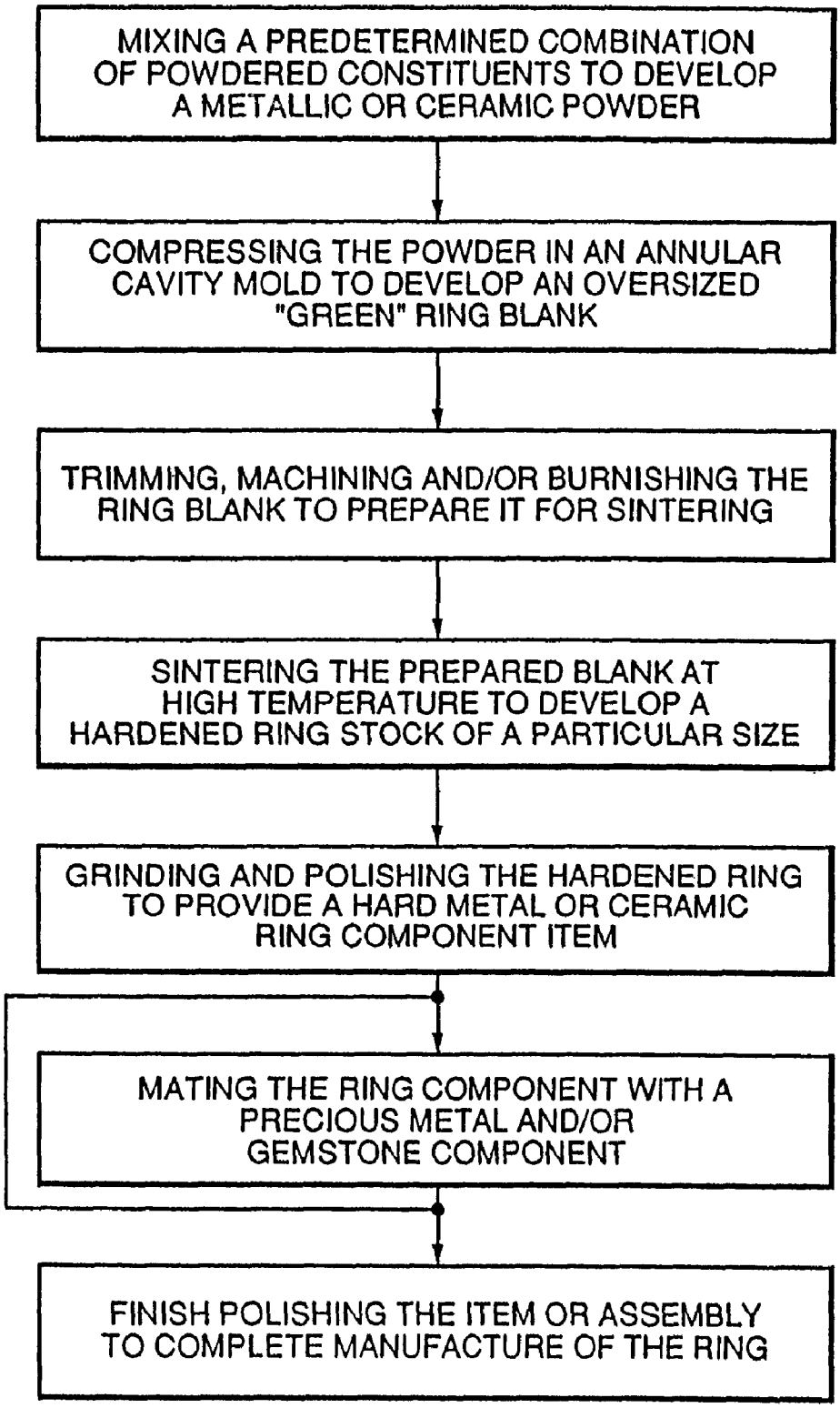
FIG. 6 is a flow chart illustrating steps followed to make jewelry in accordance with one embodiment of the present invention.
Figure 7:
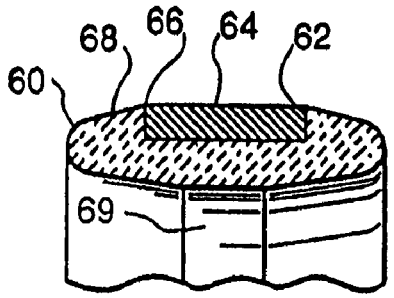
FIGS. 7–14 are partial cross-sections taken through various embodiments illustrating alternative forms of rings made in accordance with the present invention.

Turning now to FIG. 6, which is a flow diagram illustrating the various steps followed in a preferred method of making a ring in accordance with the present invention. It will be noted that once a suitable press and mold has been prepared, the first step in making a ring or other object is to mix a predetermined combination of powdered metal or ceramic constituents to develop a sinterable metallic or ceramic powder. Once properly measured and disposed within the mold cavity, the powder will be compressed by the mold to develop an oversized "green" ring blank that, although somewhat fragile, is stable enough to allow certain processing to be accomplished prior to sintering. For example, mold lines may be trimmed and smoothed, surfaces may be sanded or textured, facets may be smoothed, etc. But once properly prepared, the next step is to load the blank at room temperature into a non-atmospheric sintering chamber and raise the temperature thereof to controlled temperatures, typically varying between 1000° C. to 2000° C. and then slowly cooled back to atmospheric temperature. Once cooled, the hardened ring stock or other blank configuration can be ground and polished to provide the hard metal or ceramic ring component. At this point, precious metal components, jewels and other decoration components may be affixed to the hard metal or ceramic part. One way to affix precious metal to the part is to use a brazing process and provide the components in varied shapes of wire sheet tubing or segments of other material that can be fabricated or forged into appropriate configurations and fit into the mating groove or channel 22. Fluxed or flux free gold or silver soldered compounds varying in color and purity between 50% and 99% purity can be applied on or around desired mating surfaces of the hard material as well as the precious metal or other materials after mechanically binding the parts together with round or flat wire or heat resistant custom fixtures. Prepared fixtures with parts are then loaded at room temperature into a non-atmospheric chamber and heated to controlled temperatures varying between 1000 to 2000° C. and then allowed to cool down slowly to atmospheric temperature. This brazing operation will not interfere with the previously configured hard metal or ceramic components since their melting temperatures are substantially higher.

Another method of mating the precious metal or other components to the hardened component is to engineer the hardened component with various features such as holes, notches, slots, etc., such that various pre-shaped precious metal or other materials in mating configurations may be snapped or pressed, swaged or burnished into the hardened substructure. The resulting mechanical fit will hold the components together.

Still another method of mating the precious metal or other components to the hardened component is to bond them to the hardened part by means of one or two part hardening resin compounds that are heat and room temperature cured.

Also precious metals can be directly cast into cavities in hard metal or ceramic articles using lost wax techniques widely used in jewelry making.

But not withstanding the process used to mate the components together, once the several components are in fact combined, the entire assembly can be finished and polished to complete manufacture of the ring or other article of jewelry.

Turning now to FIGS. 7 through 14, various cross-sectional configurations of rings are depicted illustrating combinations of flats, facets, materials, inserts and component relationships. More specifically, in FIG. 7, a sintered metal part 60 is shown having a wide annular groove 62 formed in its outer surface and filled with a softer precious metal or other material 64. The top surface oft material 64 may be flush with the top edges 66 of the facets 68 or may be recessed there beneath to enhance the protective function of the hardened metal part 60. This ring might have an axial length of 2–14 mm, a wall thickness of 1–2.8 mm and have facets at angles of from about 2° to 40° relative to the cylindrical surface 69.

Figure 8:
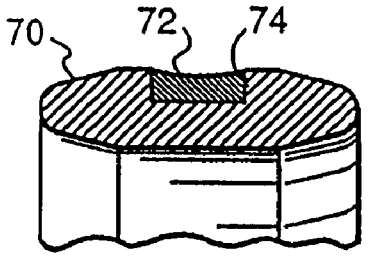

In FIG. 8, a similar ring design is depicted, but in this case, utilizing a ceramic material as the hard surfaced part 70 with the sculpted precious metal part 72 being mounted within a groove 74 formed in the outer perimeter of the hard part 70. Note the different surface effects that can be achieved by increasing the angular relationship of the various facets and by depressing or recessing the surface of the insert 72.

Figure 9:
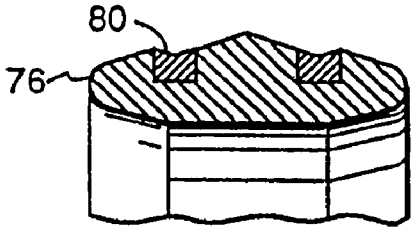
Figure 10:
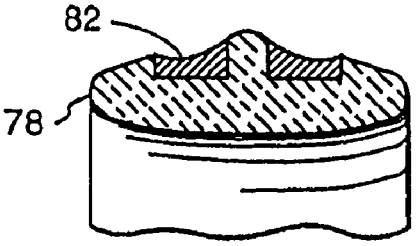

FIGS. 9–10 depict two-groove embodiments of both sintered metal and ceramic substructures at 76 and 78 respectively, each having precious metal or other inserts 80 and 82 formed in the annular grooves thereof, with the exterior surfaces of the inserts of the rings being treated differently to achieve substantially different visual effects. Note, that in either case, the "hard part" protects the softer precious metal part. Note that in the FIG. 10 embodiment, the internal surface 83 is shown aligned rather than faceted. Other embodiments may be treated likewise.

Figure 11:
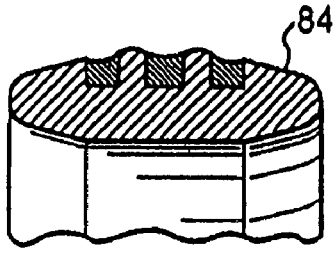

In FIG. 11, a three-groove embodiment is depicted at 84.

Figure 12:
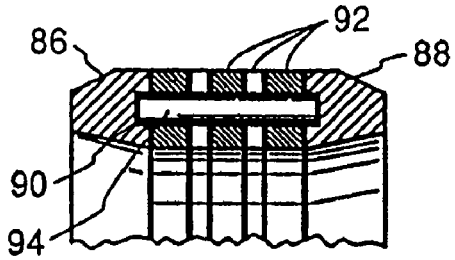
Figure 13:
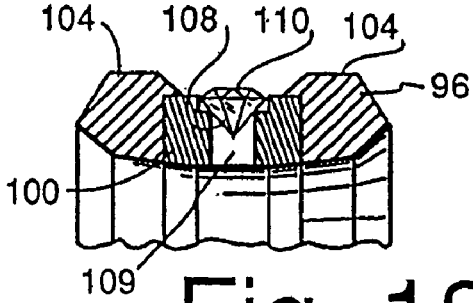
Figure 14:
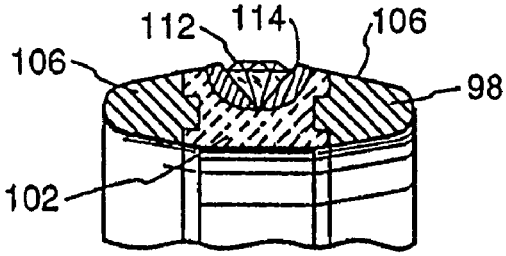

FIGS. 12–14 illustrate alternative embodiments in accordance with the present invention, wherein the hard metal or ceramic components are formed by two or more parts that are affixed together. For example, in FIG. 12, complementary annular sintered or ceramic parts 86 and 88 are provided with shallow bores 90 at several points around facing surfaces of the components, and a plurality of annular components 92 made of at least two materials 92 are sandwiched together and bored at intervals matching the bores 90, such that pins 94 may be extended through the bores in the ring components 92 with the ends thereof being extended into the bores 90 of the hardened ring components 86 and 88 to lend mechanical stability to the assembly. The various components 92 would, of course, be epoxied or otherwise bonded together.

In FIGS. 13 and 14, three-part ring assemblies are illustrated at 96 and 98 respectively, with each being comprised of a central band 100 and 102 respectively, sandwiched between and mechanically bonded to a pair of exterior rings 104 and 105 respectively. In the case of the ring assembly illustrated in FIG. 13, for example, the exterior components 104 might be of sintered metal or of ceramic while the interior band 100 might be of a precious metal, or even of a ceramic or sintered material. In the illustrated configuration, pockets 108 and azure holes 109 are formed in the interior band to receive gemstones 110 which are appropriately secured therein.

In the embodiment of FIG. 14, the interior band is depicted as being of a ceramic material sandwiched between and mechanically interlocked to exterior bands 106 made of sintered material or even precious metal, while the gemstones 112 are set in a precious metal 114.

Figure 15:
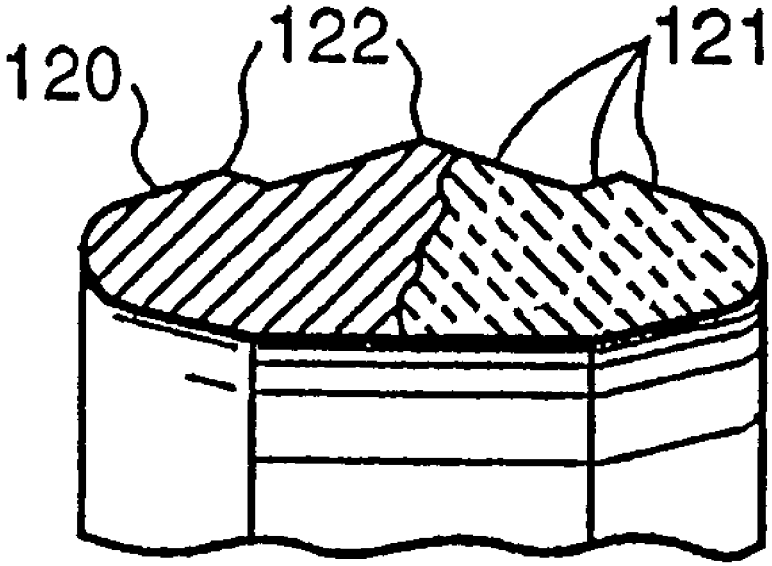
FIG. 15 illustrates a unitary multifaceted hard metal/ceramic ring.

FIG. 15. depicts at 120 a multifaceted unitary ring configuration made of a single, hard metal or ceramic substance. The six highly polished facets 121 on the outer surface of the ring create a unique design and visual impression heretofore not possible using prior art rings making techniques and technologies, because if such configuration had been made, the peaks 122 would have quickly been eroded, destroying the esthetic appearance of the ring.

Figure 16:
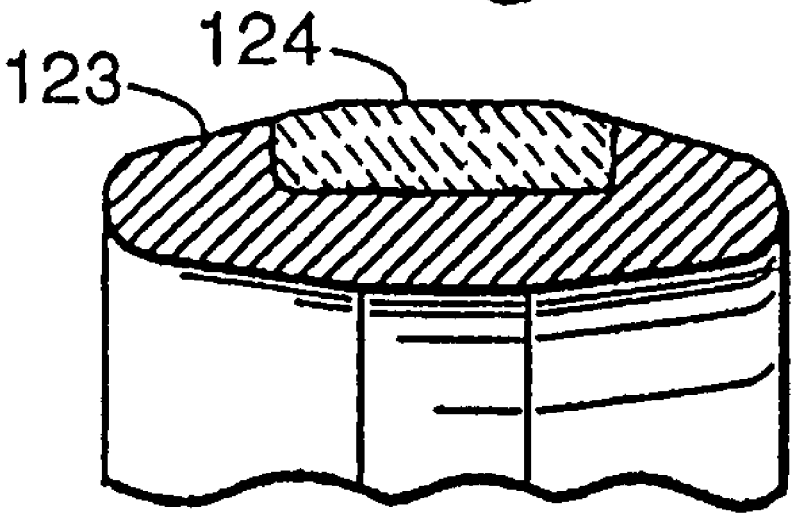
FIG. 16 depicts a precious metal ring having a hard metal/ceramic band embedded therein to provide a protective outer wear surface.

In FIG. 16 of the drawing, still another alternative embodiment is depicted wherein a ring made primarily of precious metal 123 includes an annular insert 124 embedded therein and extending above the uppermost surface of the precious metal component to provide a protective and esthetically pleasing insert.

Alternatively, one or more holes or cavities may be provided around the ring for receiving precious metals and/or set stones.

The principal concept of this invention is the provision of an ultra durable hard metal or high tech ceramic type of jewelry that may or may not incorporate precious metals and/or precious gem stones. The invention also provides a unique jewelry manufacturing process that combines hard metals with precious metals in a manner such that the precious metals are flush or recessed slightly below the outer most surfaces of the hard metals over the outer wear surfaces to achieve maximum abrasion and corrosion resistance. This is not to preclude the use of protruding precious metal or gemstone components, but in such cases the protruding components would not be protected by the harder materials. The invention involves the provision of jewelry items made from super hard metals such as tungsten and cemented carbide and high tech ceramics of various colors processed into a predetermined shape then sintered in a furnace and ground and polished into finished form. Such polished tungsten carbide jewelry articles have a grey color and a reflective mirror finish. These items may be shaped into concentric circular ring shapes of various sizes and profiles or individual parts may be ground into shapes that can be bonded to a precious metal substrate so as to protect the softer substrate. The hard metal circular designs encompass all types of profiles and cross-sectional configurations for rings, earrings and bracelets. Hard metal items may be processed with various sized and shaped openings distributed around the perimeter, with other objects of precious metal gem stones or the like secured into the various openings for cosmetic purposes. Gem stones set in precious metal may be secured into said openings for protection from scratching and daily wear.

Another configuration similar to that depicted in FIG. 11 might include several concentric rings of varying widths and thickness of precious metal or other material sandwiched between concentric rings of varying widths, thicknesses and profiles of hard metal. The components are assembled and bonded together with the softer precious metal surfaces being recessed below the adjacent surfaces of the hard metal, thereby causing all of the outer wear surfaces to be protected by the super hard metals surfaces.

Annular rings, earrings and bracelets may also be fashioned by combining variations of precious metal bands with the protective hard metal individual parts bonded onto and into slots or grooves or flat areas of the substrate precious metal bands. These hard metal parts will be positioned to give maximum protections to the precious metal parts.

Articles of jewelry may be created using symmetrical or asymmetrical grid-type patterns. Machined hard metal parts of varying shapes and sizes may be assembled and bonded onto or into a precious metal substrate designed where precious metal is recessed for maximum durability.

Articles of jewelry in accordance with the present invention may be made with various types of hard metals and precious metals where the hard metal is used for both esthetic and structural strength purposes. Hard metal rods of varying shapes and sizes may be used in conjunction with precious metals to create a unique jewelry design having a very high structural strength. Articles of jewelry may be made entirely of hard metal or a combination of hard metal and precious metal where the cosmetic surfaces of the hard metal are ground to have a faceted look. These facets are unique to hard metal configurations in that precious metal is too soft and facet edges formed in such soft metals would wear off readily with normal everyday use.

The present invention has been described above as being comprised of a molded hard metal or ceramic component configured to protect a precious metal or other component;

however, it will be appreciated that the invention is equally applicable to a multifaceted, highly polished jewelry item made solely of the hard metal composition or ceramic composition.

Furthermore, the present invention relates to a method of making jewelry wherein a rough molded and sintered part is subsequently machined to produce multiple facets and surfaces that can be highly polished to provide an unusually shiny ring surface that is highly resistant to abrasion, wear and corrosion. As used in this description, the term facet is intended to include both cylindrical and frusto conical surfaces as well as planar or flat surfaces.

Although the invention has been disclosed herein in terms of several preferred embodiments, it is anticipated that after having read the above disclosure, it will become apparent to those skilled in the art that various alterations and modifications could be made. It is therefore my intent that the following claims be interpreted as covering all such alterations and modifications as fall within the true spirit and scope of the invention.

What is claimed is:

1. A finger ring comprising: an annular body made of a sintered hard material comprising a predominantly tungsten carbide material, wherein the annular body has at least two external surfaces that are continuous and of a width sufficient to provide each external surface with a facet having a polished grey mirror finish and with the hard material being long wearing and virtually indestructible during normal use of the finger ring so that each facet retains its mirror finish, wherein each facet extends concentrically and continuously around the circumference of the ring without variations in its width, and wherein the body includes a cavity of a predetermined size and shape that is a continuous slot which extends entirely around the annular body and is configured to receive an insert of a decoration component that provides a substantially different visual effect to the ring, with the slot positioned between and adjacent to the facets, and the decoration component comprising a precious metal that is disposed in and fills the slot, which slot extends into the hard material, and the decoration component is mechanically fit with the hard material to hold the precious metal therein and wherein an outer surface of the precious metal forms a smooth transition with each facet.

2. The finger ring of claim 1, wherein the hard material comprises at least 85 weight % tungsten carbide.

3. The finger ring of claim 2, wherein a binding material is present in an amount of 3 weight % to 13 weight %.

4. The finger ring of claim 1, wherein each external surface facet is highly polished to a mirror luster that is maintained for the life of the ring and does not require re-polishing during use.

5. The finger ring of claim 1, wherein the annular body includes design details that are maintained in their original configuration indefinitely.

6. The finger ring of claim 1, wherein the hard material consists essentially of sintered tungsten carbide.

7. The finger ring of claim 1, wherein the hard material has a density of at least 13.3 g/cm$^3$.

8. The finger ring of claim 1, wherein the at least one external surface facet is curved.

9. The finger ring of claim 1, wherein the at least one external surface facet is cylindrical.

10. The finger ring of claim 1, wherein a portion of the external surface facet is rounded across a cross-section of the annular ring that is transverse to the concentric continuous portion.

11. A finger ring comprising:

an annular ring made of a sintered hard material comprising predominantly tungsten carbide, wherein the annular ring has at least one external surface that is continuous and of a width sufficient to provide an external surface facet, with the facet having a polished grey mirror finish and with the hard material being long wearing and virtually indestructible during normal use of the finger ring so that the facet retains its mirror finish, wherein the facet extends concentrically and continuously around the circumference of the ring without variations in its width, and wherein the annular ring includes a cavity of a predetermined size and shape that is a continuous slot which extends entirely around the annular ring; and a decoration component comprising a precious metal disposed in the slot to provide a substantially different visual effect to the ring, wherein the decoration component forms a second annular ring in the slot that fills a width of the slot continuously around the annular ring and that has an outer surface that is recessed from the at least one external surface facet so as to minimize contact of the outer surface with any object that contacts the finger ring.

12. The finger ring of claim 11, further comprising a metal material disposed in the slot between a portion of the annular ring and the decoration component to facilitate retention of the decoration component therein.

13. The finger ring of claim 11, further comprising a hardening-resin component disposed in the slot between a portion of the annular ring and the decoration component to facilitate retention of the decoration component therein.

14. The finger ring of claim 11, wherein the external surface of the annular ring comprises at least two external surface facets with at least one external surface facet on each opposing side of the slot.

15. The finger ring of claim 14, wherein the second annular ring has a width that is no greater than that of the slot and its outer surface forms a smooth transition with each of the external surface facets on the opposing sides of the slot.

16. The finger ring of claim 11, wherein the hard material comprises at least 85 weight % tungsten carbide.

17. The finger ring of claim 16, wherein a binding material is present in an amount of 3 weight % to 13 weight %.

18. The finger ring of claim 11, wherein the at least one external surface facet is highly polished to a mirror luster that is maintained for the life of the ring and does not require re-polishing during use.

19. The finger ring of claim 11, wherein the annular ring includes design details that are maintained in their original configuration indefinitely.

20. The finger ring of claim 11, wherein the hard material consists essentially of sintered tungsten carbide.

21. The finger ring of claim 11, wherein the hard material has a density of at least 13.3 g/cm$^3$.

22. The finger ring of claim 11, wherein the at least one external surface facet is curved.

23. The finger ring of claim 11, wherein the at least one external surface facet is cylindrical.

24. The finger ring of claim 11, wherein a portion of the external surface facet is rounded across a cross-section of the annular ring that is transverse to the concentric continuous portion.

* * * * *